US005131108A

United States Patent [19]

Sessa et al.

[11] Patent Number: 5,131,108

[45] Date of Patent: Jul. 21, 1992

[54] INTACT SHOE LACING SYSTEM

[75] Inventors: Scott C. Sessa, Ada; Gerald Conley, Grand Rapids, both of Mich.

[73] Assignee: Wolverine World Wide, Inc., Rockford, Mich.

[21] Appl. No.: 816,666

[22] Filed: Jan. 3, 1992

Related U.S. Application Data

[63] Continuation of Ser. No. 655,844, Feb. 15, 1991, abandoned.

[51] Int. Cl.[5] ..... A43B 11/00

[52] U.S. Cl. ..... 12/142 LC; 36/50.1

[58] Field of Search ..... 36/50, 136; 24/712, 24/712.1, 712.2, 712.5; 12/142 LC, 142 R

[56] References Cited

U.S. PATENT DOCUMENTS

| | | | |
|---|---|---|---|
| 526,830 | 10/1894 | Julje | 24/712.5 |
| 3,208,164 | 9/1965 | Hoyt, Jr. | 36/50 |
| 4,291,439 | 9/1981 | Riti | 24/712.2 |
| 4,403,375 | 9/1983 | Bum | 24/712.2 |
| 4,458,373 | 7/1984 | Maslow | 12/142 LC |
| 4,553,293 | 11/1985 | Bum | 36/50 |
| 4,571,854 | 2/1986 | Edens | 36/50 |
| 4,780,936 | 11/1988 | Breecher | 24/712.2 |
| 4,790,048 | 12/1988 | Arnt | 36/50 |
| 4,879,787 | 11/1989 | Walls | 24/712.2 |
| 4,967,454 | 11/1990 | Elieff | 24/712.1 |

FOREIGN PATENT DOCUMENTS

| | | | |
|---|---|---|---|
| 0079874 | 5/1983 | European Pat. Off. | 24/712.1 |

*Primary Examiner*—Steven N. Meyers

*Attorney, Agent, or Firm*—Price, Heneveld, Cooper, DeWitt & Litton

[57] ABSTRACT

A combination shoe, lace and new merchandise indicia and lace retainer, the shoe being fully or substantially fully laced, and the new merchandise indicia and lace retainer having a central portion looped around doubled end portions of the lace and having overlapping end portions secured together. The doubled end portions of the lace and the new merchandise indicia and lace retainer are tucked into the foot inlet of the shoe during storage and are pulled out of the foot inlet for trial fit of the shoe.

2 Claims, 2 Drawing Sheets

INTACT SHOE LACING SYSTEM

This is a continuation of application Ser. No. 07/655,844, filed Feb. 15, 1991 now abandoned.

BACKGROUND OF THE INVENTION

This invention relates to shoe lacing. When shoes are normally packaged for sale, the laces are put through the two lowest lacing holes, tied off, and then stuffed inside the shoe. This technique requires the shoe salesman in the retail store, or the customer himself, to lace up the shoe prior to trying it on. A significant amount of time is required for the salesman or customer to do this. This time is not available for the salesman to serve others and therefore costs the store money and possible sales. It would be less expensive to have the shoes laced in the factory, e.g., in the Far East using lower cost labor. However, if the shoe has been laced up, it gives the impression of not being new. This is, of course, undesirable in new merchandise.

SUMMARY OF THE INVENTION

An object of this invention is to provide shoe lacing enabling new shoes to be fully or nearly fully laced,.and yet having the appearance and impression of new merchandise. The laces are retained in attractive fashion, enabling the shoe to be applied to a potential buyer's foot as new merchandise. Extra time is not necessary for fully lacing the shoe. Moreover, the shoe and lacing enable the potential buyer to put the shoe on his foot without disruption of the lacing arrangement, for an initial reaction to shoe fit and appearance on his/her foot. The novel shoe and lacing involve the use of new merchandise indicia for retaining the outer end portions of the shoe laces. Even if the indicia is temporarily removed, it can be subsequently readily replaced, to retain the new merchandise appearance.

DESCRIPTION OF THE PREFERRED EMBODIMENT

Figure 1:
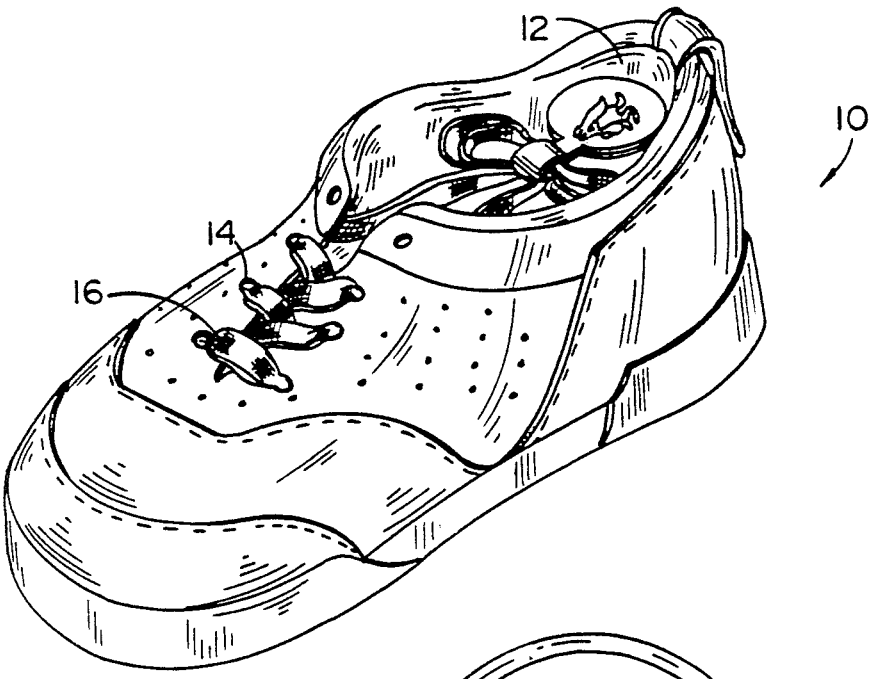
FIG. 1 is a perspective view of a shoe, shoe lacing and new shoe indicia combination according to this invention.
Figure 2:
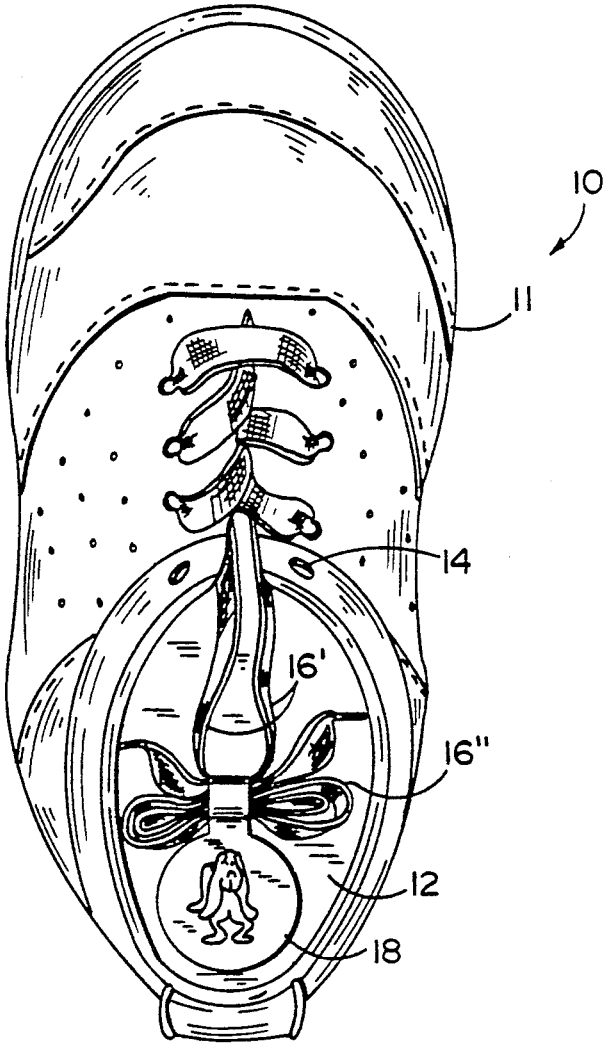
FIG. 2 is a plan view of the combination in FIG. 1.
Figure 3:
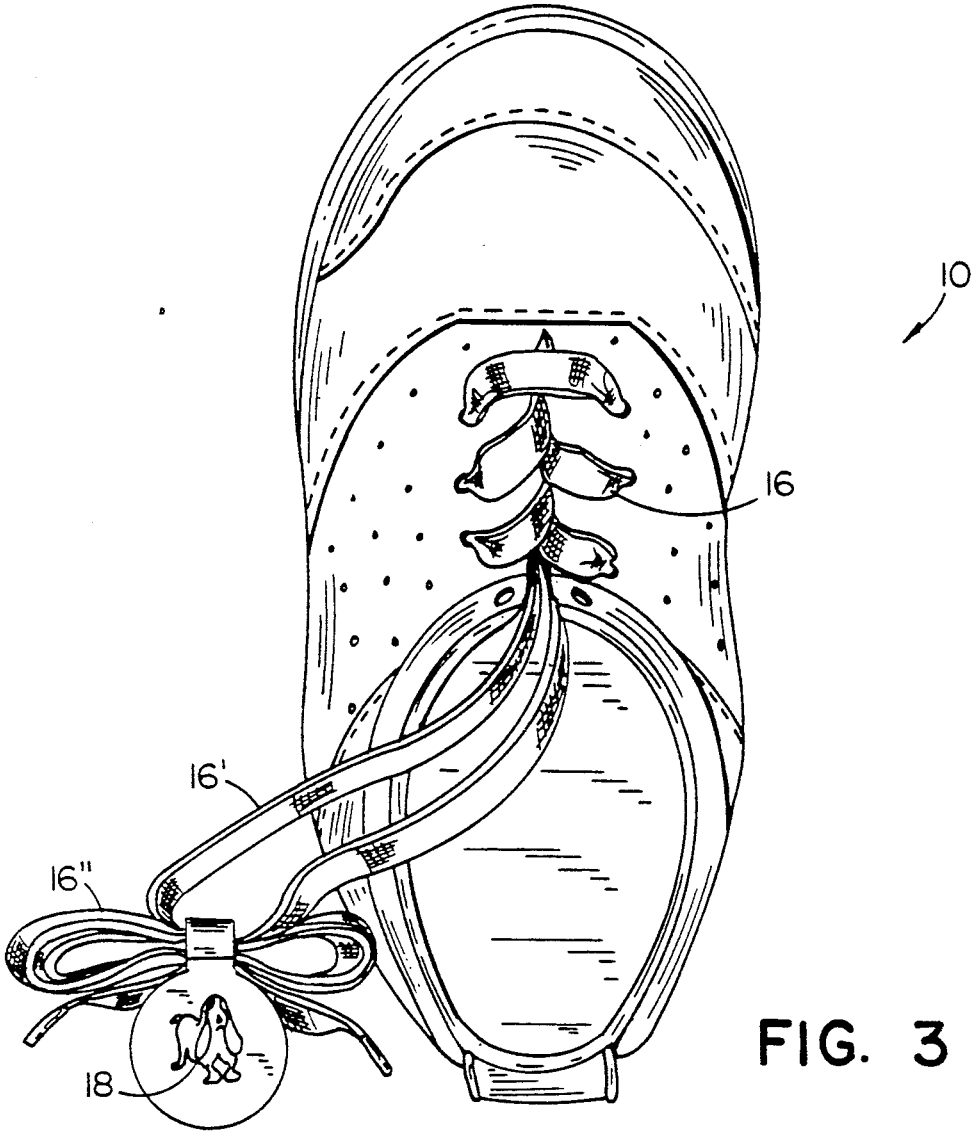
FIG. 3 is a plan view of the combination showing the end portions of the lacing and the new shoe indicia removed from inside the shoe.
Figure 4:
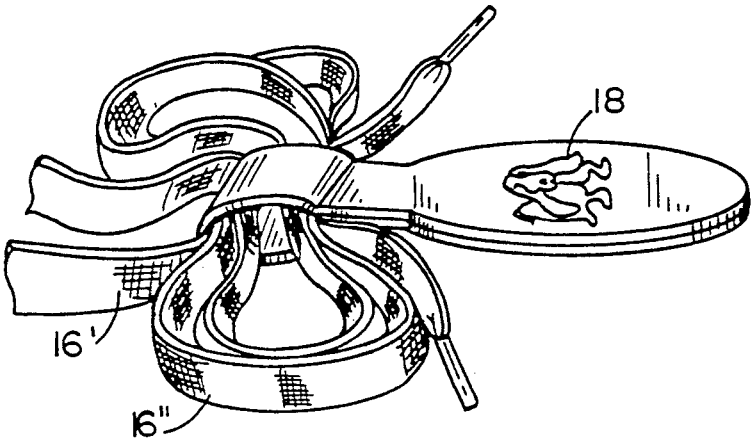
FIG. 4 is an enlarged, fragmentary, perspective view of the end portions of the lacing and new shoe indicia.

Referring now specifically to the drawings, the complete shoe and lacing 10 comprises a lace type shoe 11 having a foot inlet opening 12 and a plurality of lacing eyelets 14 associated with the opening, i.e., astraddle the forward part of the opening in conventional fashion. A shoe lace 16 is fully or substantially fully laced in said eyelets, the particular example illustrated having only the uppermost pair of eyelets not laced. The shoe lace has elongated ends 16' extending from upper lacing eyelets with sufficient length to be tied. These elongated ends 16' have outer end portions which are doubled over as shown at 16''. These doubled outer end portions are retained in position by a removable new merchandise indicia and lace retainer 18, shown to be a paper or plastic wrap around tab. The new merchandise indicia tab is shown to have at least one enlarged end portion and a second end portion overlapped and in engagement with each other, and connected by an elongated central portion which has a loop that wraps around the folded over, lace end portions, so that the rear faces of the end portions can engage and be secured to each other. A suitable retaining substance such as a releasable adhesive, a "Velcro" hook and loop material, or the like is attached to these mating rear faces to cause the end portions to stick together. On the face of at least one of these end portions is preferably a trademark of the shoe supplier, . such as the mark of the assignee herein, as depicted. The exclusive trademark assures the potential buyer that the merchandise is new.

In use, the elongated ends and folded and retained outer end portions of the laces, as well as the new merchandise indicia, are normally tucked into the foot inlet opening 12 of the shoe. When a customer wishes to try the shoe on, the salesman simply pulls the elongated end portions of the laces and the new merchandise indicia out of the shoe to enable a foot to be placed in the shoe. There is sufficient slack in the laces to enable the foot receiving opening to be spread sufficiently for the foot to be inserted into the shoe without removing the new merchandise indicia from the laces. The lace can be tightened considerably by pulling on the ends 16'. If it is deemed necessary to tie the laces, the new merchandise indicia can be temporarily removed and subsequently replaced to retain the new look.

It is conceivable that certain minor variations of the development may be made without departing from the novel concept set forth. Hence, the invention is not intended to be limited specifically to the preferred illustrative embodiment, but only by the scope of the appended claims and the reasonably equivalent structures to those defined therein.

The embodiments of the invention in which an exclusive property or privilege is claimed are defined as follows:

1. A method trial fitting a laced-up, new shoe on the foot of a prospective customer, without the necessity of lacing and/or unlacing the shoe, comprising the steps of:

providing a lace-type shoe having the following features: a foot inlet opening and a plurality of lacing eyelets associated with said opening, a shoelace at least substantially fully laced in said eyelets, said shoelace having two elongated ends extending from the upper lacing eyelets with sufficient length to be tied, said elongated ends having outer end portions doubled over, and a removable, new merchandise indicia and lace retainer on said doubled outer end portions of said lace, enabling said new merchandise indicia and lace retainer and said doubled outer end portions to be tucked into said foot receiving opening for storage;

pulling said elongated ends of the lace and the new merchandise indicia and lace retainer out of the shoe;

spreading the foot inlet opening to allow a foot to be inserted, thereby pulling slack out of said elongated ends;

inserting the foot into said foot inlet opening of said shoe; and pulling said elongated ends of the lace and thereby tightening the lace on the foot for a trial fitting wherein said steps of spreading the foot inlet opening, inserting the foot into said foot inlet opening and pulling said elongated ends of the lace are performed without removing the new merchandise indicia from the laces.

2. The method of claim 1 followed by the steps of removing the foot from said shoe; pulling said elongated ends of the lace to tighten the lace; and tucking the pulled elongated ends of the lace and said new merchandise indicia back into said foot inlet opening without unlacing the shoe so as to be ready to trial fit the next potential customer.

* * * * *

UNITED STATES PATENT AND TRADEMARK OFFICE

CERTIFICATE OF CORRECTION

PATENT NO. : 5, 131,108

DATED : July 21, 1992

INVENTOR(S) : Scott C. Sessa and Gerald Conley

It is certified that error appears in the above-identified patent and that said Letters Patent is hereby corrected as shown below:

Column 2, line 11;
After "supplier," delete -- . --;

Column 2, line 39, claim 1;
After "method" insert -- of --;

Column 2, line 55, claim 1;
After "opening" insert -- of the shoe --.

Signed and Sealed this

Fifth Day of October, 1993

*Attest:*

*Attesting Officer*

BRUCE LEHMAN

*Commissioner of Patents and Trademarks*